US006650198B2

(12) United States Patent
Hasegawa

(10) Patent No.: US 6,650,198 B2
(45) Date of Patent: Nov. 18, 2003

(54) IRREVERSIBLE CIRCUIT COMPONENT AND COMMUNICATION DEVICE

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/036,693

(22) Filed: Nov. 7, 2001

(65) Prior Publication Data

US 2002/0149437 A1 Oct. 17, 2002

(30) Foreign Application Priority Data

Nov. 7, 2000 (JP) ..... 2000-339649

(51) Int. Cl.[7] ..... H01P 1/36
(52) U.S. Cl. ..... 333/24.2; 333/1.1
(58) Field of Search ..... 333/1.1, 24.2; H01P 1/383, 1/36

(56) References Cited

FOREIGN PATENT DOCUMENTS

| | | | | |
|---|---|---|---|---|
| JP | 09-326604 A | * | 12/1997 | ..... H01P/1/36 |
| JP | 10-084205 A | * | 3/1998 | ..... H01P/1/383 |
| JP | 11-097911 A | * | 4/1999 | ..... H01P/1/383 |

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

In an irreversible (non reciprocal) circuit component, a resin member is arranged between a permanent magnet, and a matching capacitor or the like. The port of a center electrode and the terminal electrode on the hot side of the matching capacitor are electrically connected on the top face of the matching capacitor element, and also, an output lead-out electrode is electrically connected to them. A convexity may be formed on the under face of the resin member, and a convexity is formed on the bottom of the resin case. The convexity of the resin case contacts the under face of the resin member.

10 Claims, 10 Drawing Sheets

IRREVERSIBLE CIRCUIT COMPONENT AND COMMUNICATION DEVICE

BACKGROUND OF THE INVENTION

1. Field of the invention

The present invention relates to an irreversible circuit device and a communication device.

2. Description of the Related Art

Generally, a lumped-constant isolator (one type of irreversible circuit device) employed in mobile communication devices such as portable telephones or the like has a function of allowing a signal to pass only in the transmission direction and blocking the transmission of a signal in the reverse direction. Moreover, for recent mobile communication devices, higher reliability and lower cost have been required, due to the type of use. Accordingly, for the lumped-constant isolators as well, higher reliability and lower cost have been strongly required.

The above-described lumped-constant isolators each comprise a permanent magnet, a ferrite to which a DC magnetic field is applied, a plurality of center electrodes arranged on the ferrite, a capacitor element for matching, a resin member arranged between the permanent magnet and the matching capacitor element, a resin case which accommodates the ferrite, the center electrodes and the matching capacitor element, an upper case made of a magnetic metal which accommodates the permanent magnet, the ferrite, and the center electrodes, a lower case made of a magnetic metal, and other components known to skilled persons.

FIG. 17 is a vertical cross-sectional view of a part of a conventional isolator in which a matching capacitor element is arranged. In an isolator 200, a matching capacitor element C is soldered in a lower case 4 formed integrally with a resin case 3. A center electrode P is arranged on the top face of an input-output lead-out electrode 235 formed integrally with the resin case 3 and the matching capacitor element C. The input-output lead-out electrode 235 and the matching capacitor element C are electrically connected to the center electrode P. A resin member 230 is arranged so as to cover the input-output lead-out electrode 235, the matching capacitor element C, and the center electrode P. A convexity 231 is formed on the under face of the resin member 230 to contact the center electrode P. Reference numerals 8 and 9 designate an upper case and a permanent magnet, respectively.

In this case, the resin member 230 and the matching capacitor element C compactly sandwich the center electrode P in the thickness direction. The reason for this arrangement is to reduce the number of the assembly steps, and also, to prevent the so-called "tombstone" or "chip-rising" phenomenon, which may occur upon melting of the solder with which the matching capacitor element C is soldered, which may occur when the isolator is heated.

Referring to the structure of the isolator 200, the matching capacitor element C and the center electrode P are electrically connected to each other on the top face of the matching capacitor element C. The resin member 230 locally presses the top face of the center electrode P. Accordingly, the pressure applied when the isolator 200 is assembled, that is, when the permanent magnet 9 and the upper case 8 are mounted, is transmitted to the matching capacitor element C via the resin member 230 and the center electrode P. Thus, the pressure concentrates onto the parts of the matching capacitor element C and the center electrode P which contact each other. In some cases, the matching capacitor element C is broken.

Problems arise especially when the under face of the matching capacitor element C contacts both of the lower case 4 and the resin case. With this arrangement the matching capacitor element C is readily broken.

SUMMARY OF THE INVENTION

In response to these problems, the present invention can provide an irreversible circuit component which can easily be assembled and handled, and which has high reliability.

According to the present invention, an irreversible circuit component may comprise a permanent magnet, a ferrite to which the permanent magnet applies a DC magnetic field, plural center electrodes arranged on the ferrite, an internal component, a resin member arranged above the internal component, a metal case accommodating the permanent magnet, the ferrite, and the center electrodes, and a resin case accommodating the ferrite, the center electrodes, the internal component, and the resin member, the resin case contacting at least two contact-portions on the main face on the internal component side of the resin member.

The internal component is a resistance element, a matching capacitor element, or the like. The convexities formed on the resin case may contact the contact-portions of the resin member. The contact-portions of the resin member may comprise convexities, respectively. Moreover, the bottom of the internal component may contact the inner wall of the resin case and the surface of the metal case exposed to the inner wall of the resin case.

With the above-described structure, the pressure used when the permanent magnet and the metal case are mounted, is divided and applied to both the resin case and the internal component. Thus, the pressure applied to the internal component is reduced. This suppresses the internal component from being broken.

Preferably, the number of the at least two contact-portions is three. Thereby, the positional shifting of the ferrite (specifically, a disk-shaped ferrite) can be prevented.

Preferably, the resin member and the resin case are made of a material selected from either a liquid crystal polymer or PPS. The liquid crystal polymer and PPS have high heat resistance and low loss. Thus, the irreversible circuit component can be provided with high reliability.

In the irreversible circuit component of the present invention, the resin member may be omitted. In this case, the resin case contacts the at least two contact-portions on the main face on the internal component side of the permanent magnet.

A communication device in accordance with the present invention includes the irreversible circuit component having the above-described characteristics. Thus, the communication device can be provided with low cost and high reliability.

Other features and advantages of the present invention will become apparent from the following description of the invention which refers to the accompanying drawings.

DESCRIPTION OF EMBODIMENTS OF THE INVENTION

Figure 1:
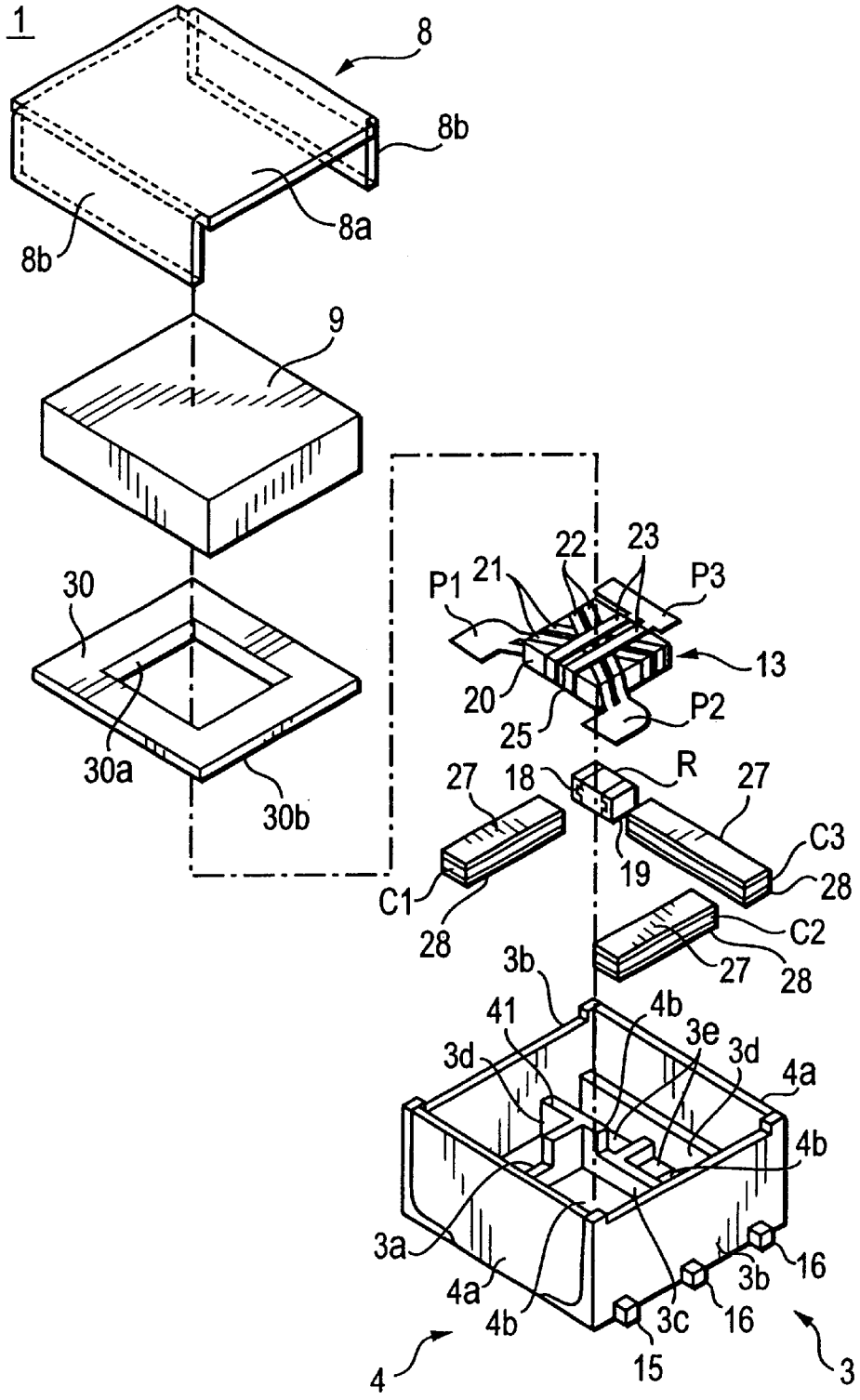
FIG. 1 is an exploded perspective view of a irreversible circuit component according to a first embodiment of the present invention.

Hereinafter, embodiments of an irreversible circuit component and a communication device according to the present invention will be described with reference to the accompanying drawings. In the respective embodiments, the same parts or portions are designated by the same reference numerals, respectively, and the repeated description is omitted.

First Embodiment

Figure 2:
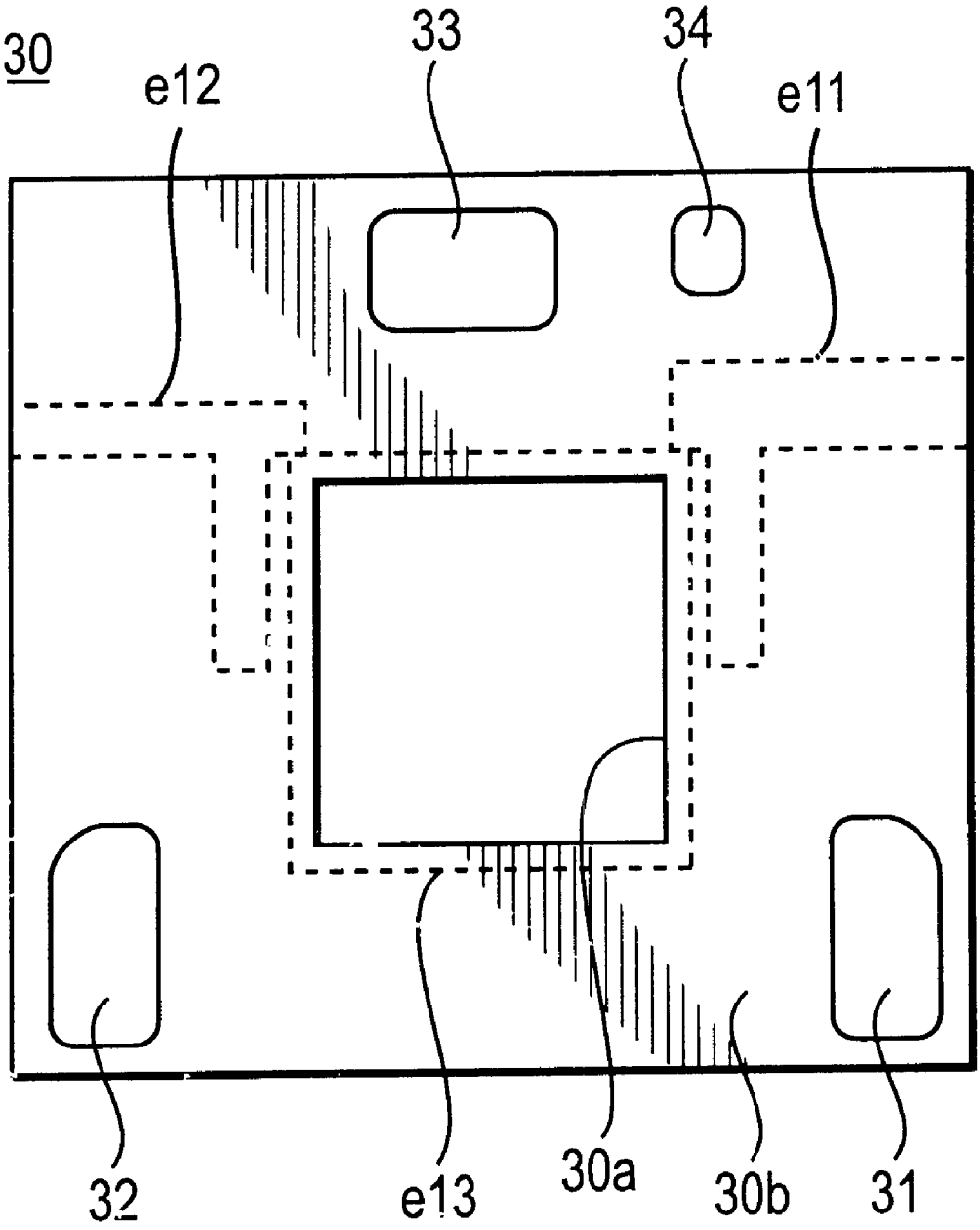
FIG. 2 is a plan view of the resin member of FIG. 1, viewed from the under side thereof.
Figure 3:
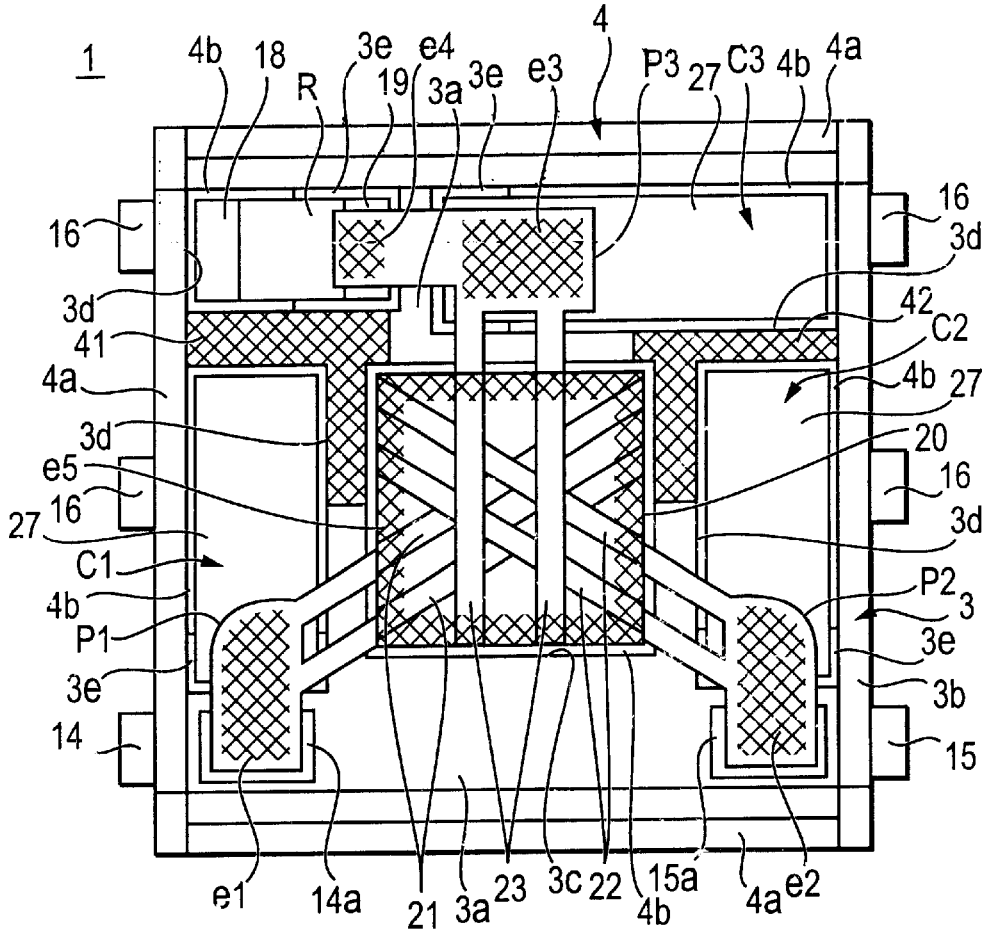
FIG. 3 is a plan view of the inside of the irreversible circuit component of FIG. 1.
Figure 4:
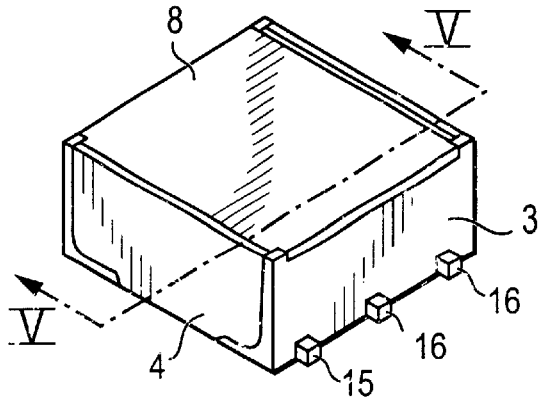
FIG. 4 is a perspective view showing the appearance of the irreversible circuit component of FIG. 1 after the assembly is completed.

FIG. 1 is an exploded perspective view showing the structure of an irreversible circuit component according to a first embodiment of the present invention. FIG. 2 is a plan view of the resin member 30 viewed from the side of the under face 30*b* thereof. FIG. 3 is a plan view showing the inside of the irreversible circuit component 1 shown in FIG. 1. FIG. 4 is a perspective view showing the appearance of the irreversible circuit component 1 of FIG. 1 after the assembly is completed. The irreversible circuit component 1 is a lumped-constant isolator.

The lumped-constant isolator 1 comprises the upper case 8 made of magnetic metal, the lower case 4 made of magnetic metal, the resin case 3, a center electrode assemblage 13, the permanent magnet 9, the resistance element R, the matching capacitor elements C1 to C3, a resin member 30, and so forth, as shown in FIG. 1.

The lower case 4 comprises side walls 4*a* and the bottom wall 4*b*. The lower case 4 is formed integrally with the resin case 3 by an insert-molding process. Two ground terminals 16 are provided so as to extend respectively from a pair of sides opposed to each other of the bottom wall 4*b* of the lower case 4. Moreover, the upper case 8 has a rectangular shape in the plan view thereof, and comprises the upper wall 8*a* and the side walls 8*b* on the right and left sides. The lower case 4 and the upper case 8 are formed by punching a sheet material with a high magnetic permeability, e.g., made of Fe or silicon steel, bending, and plating the surface with Cu or Ag.

As regards the center electrode assemblage 13, three center electrodes 21 to 23 are arranged on the top side of a rectangular-shaped microwave ferrite 20 so as to intersect substantially at intervals of 120° with insulating sheets (not shown) being interposed between them. The center electrodes 21 to 23 have ports P1 to P3 at first ends thereof, extending in the horizontal direction. Moreover, a common ground electrode 25 connected to the second ends of the center electrodes 21 to 23 is formed so as to contact the under side of the ferrite 20. The common ground electrode 25 substantially covers the under side of the ferrite 20, extends through a window 3*c* of the resin case 3, which will be described later, and is connected to the bottom wall 4*b* of the lower case 4 and grounded by soldering or the like. The center electrodes 21 to 23 and the ground electrode 25 are made of a conductive material such as Ag, Cu, Au, Al, Be, or the like, and are formed integrally with each other by punching a metal thin-sheet, etching, and so forth.

Referring to the matching capacitor elements C1 to C3, the terminal electrodes 27 on the hot sides, which are positioned on the top sides of dielectric ceramic substrates, are electrically connected to the ports P1 to P3, respectively, and the terminal electrodes 28 on the cold sides (ground sides) are soldered to the bottom wall 4*b* of the lower case 4 exposed to the windows 3*d* of the resin case 3, respectively.

Figure 6:
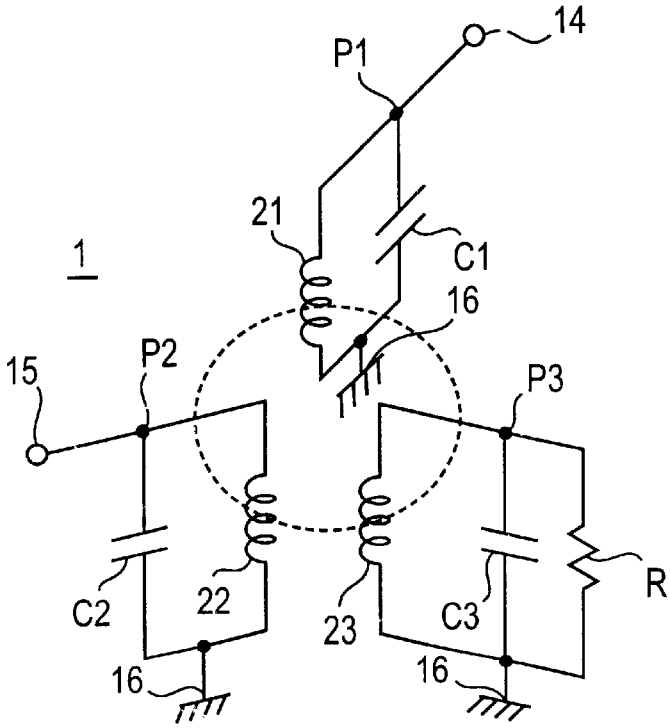
FIG. 6 is an electrical equivalent circuit diagram of the irreversible circuit component shown in FIG. 4.

Referring to the resistance element R, the terminal electrode 18 on the ground side and the terminal electrode 19 on the hot side are formed on both ends of an insulating substrate by thick-film printing or the like. A resistor comprising a thick film made of a cermet type, a carbon type, a ruthenium type, or the like, or a metal thin film is arranged between the terminal electrodes 18 and 19. As a material for the insulating substrate, for example, dielectric ceramics such as alumina or the like are used. A coating film made of glass or the like may be formed on the surface of the resistor. The terminal electrode 18 on the ground side is soldered to the bottom wall 4*b* of the lower case 4 exposed to the windows 3*d* of the resin case 3. The terminal electrode 19 on the hot side is soldered to the port P3 on the top face of the resistance element R. That is, the matching capacitor element C3 and the resistance element R are electrically connected in parallel to each other between the port P3 of the center electrode 23 and the ground terminal 16, as shown in FIG. 6.

As the solder, Sn—Sb type, Sn—Pb type, or Sn—Ag type solder is used. Specially, a non-lead type solder, that is, the Sn—Sb type solder having a high melting point is preferably used from the standpoint of the prevention of environmental contamination and for improved reflow soldering properties in the irreversible circuit component 1.

As shown in FIG. 1, the resin case 3 has a bottom 3*a* and two sides 3*b*. A rectangular window 3*c* is formed in the center of the bottom 3*a*. Windows 3*d* for accommodating the matching capacitor elements C1 to C3 and the resistance element R are formed around the periphery of the window 3*c*. The bottom wall 4*b* of the lower case 4 is exposed to the windows 3*c* and 3*d*. An input terminal 14 (see FIG. 3) and an output terminal 15 are insert-molded with the resin case 3. One end of each of the input and output terminals 14 and 15 is exposed to the outer surface of the resin case 3, while the other end is exposed to the bottom 3*a* of the resin case 3. Thus, an input lead-out electrode 14*a* and an output lead-out electrode 15*a* are formed. The ground terminals 16 are led out from the outer faces opposed to each other of the resin case 3.

As shown in FIGS. 1 and 3, convexities 41 and 42 are formed on the bottom 3*a* of the resin case 3. The heights H of the convexities 41 and 42 (see FIG. 5) are in the range of about 10 to 200 mm, for example. Preferably, the height H is substantially equal to the thickness t of the ports P1 to P3 (typically, in the range of 30 to 100 mm). In the first embodiment, the height H of the convexities 41 and 42 is set at a value equal to the sum to the height h of the convexity 32 formed on the under face 30*b* of the resin member 30 and the thickness t of the ports P1 to P3. Preferably, the material for the resin case 3 is a liquid crystal polymer or PPS (polyphenylene sulfide resin). The liquid crystal polymer and the PPS are superior in heat resistance and loss.

As shown in FIG. 1, the resin member 30 has a substantially rectangular shape in the plan view, and is arranged on the resistance element R and the matching capacitor elements C1 to C3. As shown in FIG. 2, a hole 30*a* is formed in the center of the resin member 30 to reduce the height of the isolator 1. As regards the hole 30*a*, the peripheral portion of the hole 30*a* on the under side 30*b* contacts the area e5 (see FIG. 3) shown by slanting lines in a lattice pattern of the center electrode assemblage 13, so that the hole 30*a* accommodates the center electrodes 21 to 23 and the insulating sheet overlaid on the center portion of the top face of the center electrode assemblage 13. The hole 30*a* is not necessarily provided.

As shown in FIG. 2, convexities 31 to 34 are formed on the under face 30*b* of the resin member 30. As shown in FIGS. 2 and 3, the convexity 31 presses, from the upper side, the area e1 of the port P1 of the center electrode 21 shown by slanting lines in the lattice pattern, so that the port P1 is securely connected to the terminal electrode 27 on the hot side of the matching capacitor element C1 and the input lead-out electrode 14*a* of the input terminal 14. The convexity 32 presses, from the upper side, the area e2 of the port P2 of the center electrode 22 shown by slanting lines in the lattice pattern, so that the port P2 is securely connected to the terminal electrode 27 on the hot side of the matching capacitor element C2 and the output leadout electrode 15*a* of the output terminal 15. The convexity 33 presses, from the upper side, the area e3 of the port P3 of the center electrode 23 shown by slanting lines in the lattice pattern, so that the port P3 is securely connected to the terminal electrode 27 on the hot side of the matching capacitor element C3. The convexity 34 presses, from the upper side, the area e4 of the port P3 of the center electrode 23 shown by slanting lines in the lattice pattern, so that the port P3 is securely connected to the terminal electrode 19 on the hot side of the resistance element R. The area e13 in the periphery of the hole 30*a* presses, from the upper side, the area e5, shown by slanting lines in the lattice pattern, on the top face in the periphery of the center electrode assemblage 13, so that the ground electrode 25 of the center electrode assemblage 13 is securely connected to the bottom wall 4*b* of the lower case 4. As a material for the resin member 30, liquid crystal polymers and PPS (polyphenylene sulfide resin) are preferable, since the liquid crystal polymers and PPS have a high heat resistance and a low loss.

Referring to the above-described components, the center electrode assemblage 13, the matching capacitor elements C1 to C3, the resistance element R, and so forth are accommodated in the resin case 3 formed integrally with the lower case 4. Moreover, the resin member 30 and the permanent magnet 9 are placed thereon. Then, the upper case 8 is mounted thereon. The permanent magnet 9 applies a DC magnetic field to the center electrode assemblage 13. The lower case 4 and the upper case 8 are bonded to form a metal case, which constitutes a magnetic circuit and also functions as a yoke.

Figure 5:
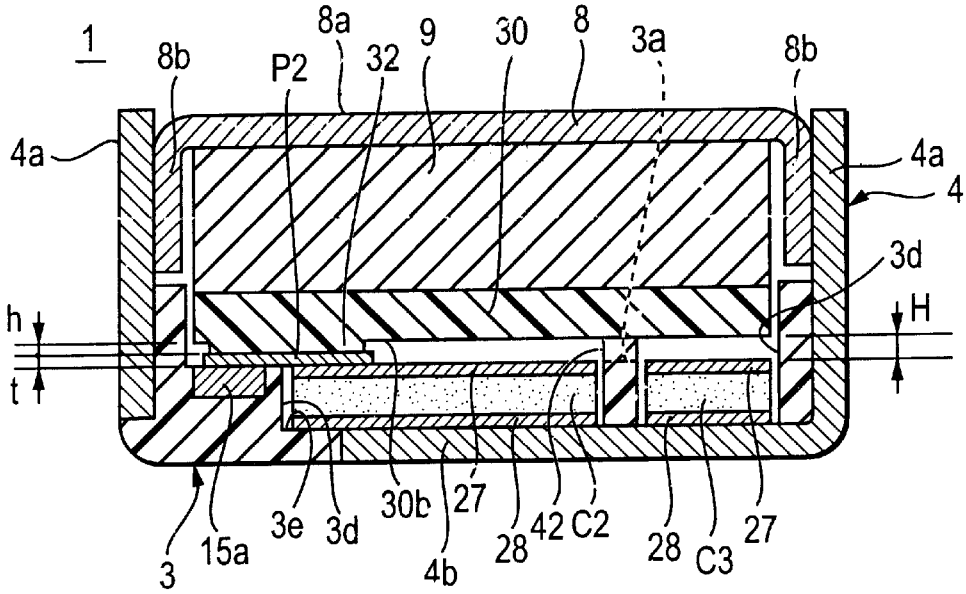
FIG. 5 is a cross-sectional view of the irreversible circuit component taken along line V—V in FIG. 4.

Thus, the lumped-constant isolator 1 shown in FIGS. 4 and 5 is obtained. The lumped-constant isolator 1 has a size of 4.0 mm long×4.0 mm wide×2.0 mm thick. FIG. 6 is an electrical equivalent circuit diagram of the lumped-constant isolator 1.

Referring to the isolator 1, as shown in FIG. 5, when the resin member 30 is mounted in the resin case 3, the convexities 31 to 34 of the resin member 30 come into contact with the areas e1 to e4 of the ports P1 to P3 shown in FIG. 3, and also, the areas e11 and e12 of the resin member 30 shown by dotted lines come into contact with the portions shown by slanting lines in the lattice pattern of the convexities 41 and 42 of the resin case 3 shown in FIG. 3, respectively. Moreover, the area e13 in the periphery of the hole 30*a* shown in FIG. 2 contacts the area e5 in the periphery of the center electrode assemblage 13 shown in FIG. 3.

As shown in FIG. 5, the height H of the convexity 42 of the resin case 3 is set to be substantially equal to the sum of the thickness t of the port P2 of the center electrode 22 and the height h of the convexity 32 of the resin member 30. Therefore, the pressure with which the permanent magnet 9 and the upper case 8 are mounted is divided between the respective pressures applied to the convexities 41 and 42 formed on the resin case 3 and the input-output lead-out electrodes 14*a* and 15*a*, the pressures applied to the matching capacitor elements C1 to C3, and the resistance element R, and the ferrite 20 of the center electrode assemblage 13. That is, the respective pressures transmitted to the matching capacitor elements C1 to C3, the resistance element R, and the center electrode assemblage 13 are reduced.

Moreover, when the under faces of the resistance element R and the matching capacitor elements C1 to C3 contact the bottom wall 4*b* of the lower case 4 and also the element-contact portions 3*e* of the resin case 3, respectively, that is, when the materials having different elasticities are arranged beneath the under faces of the resistance element R and the matching capacitor elements C1 to C3, the difference in displacement between the bottom wall 4*b* of the lower case 4 and the element-contact portions 3*e* of the resin case 3 can enhance the breaking-prevention effect. As a result, breaking of the matching capacitor elements C1 to C3, the resistance element R, and the ferrite 20 of the center electrode assemblage 13 can be prevented. The isolator 1 which is superior in impact resistance, and has a structure which facilitates the assembly and the handling, and has a high reliability and a low cost can be provided.

Figure 7:
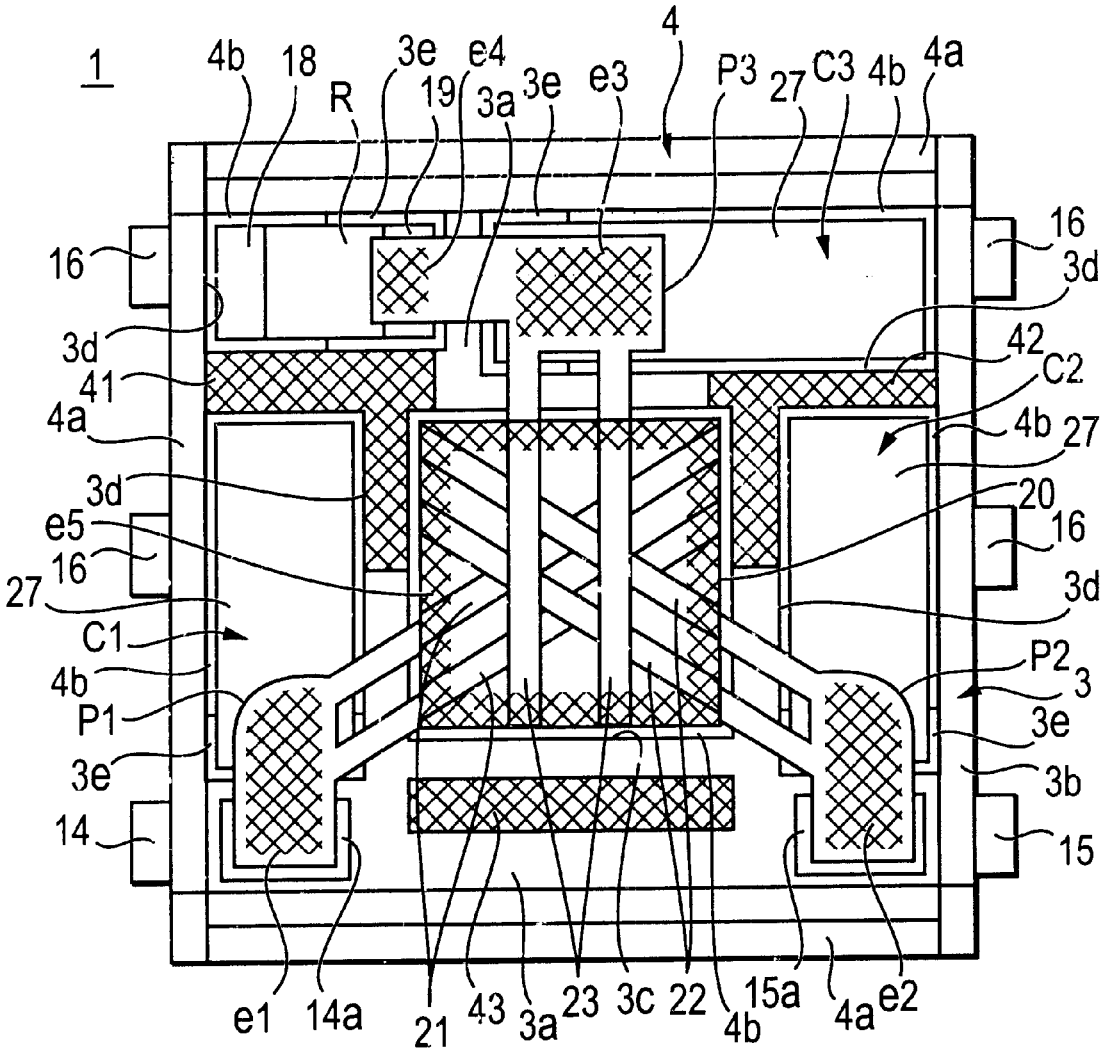
FIG. 7 is a plan view showing the inside of a modification of the irreversible circuit component of FIG. 1.

For the isolator 1, further different modifications are possible. For example, as shown in FIG. 7, a convexity 43 may be further formed on the bottom 3*a* of the resin case 3. The convexities 41 to 43 are provided between the ports P1 to P3 so as not to contact the ports P1 to P3 of the center electrodes 21 to 23, respectively. Accordingly, the center electrodes 21 to 23 are led out through the spaces formed between the convexities 41 to 43, respectively, and the ports P1 to P3 are arranged in the areas sectioned by the convexities 41 to 43. As a result, the positions of the ports P1 to P3 are restrained by the convexities 41 to 43. Thus, the position of the center electrode assemblage 13 can be prevented from shifting. In particular, when the ferrite has a disk shape, the positional shifting readily occurs, due to the rotation of the ferrite 20. However, since the positions of the ports P1 to P3 are restrained by the convexities 41 to 43, the positional shifting of the center electrode assemblage 13 can be effectively prevented.

Figure 8:
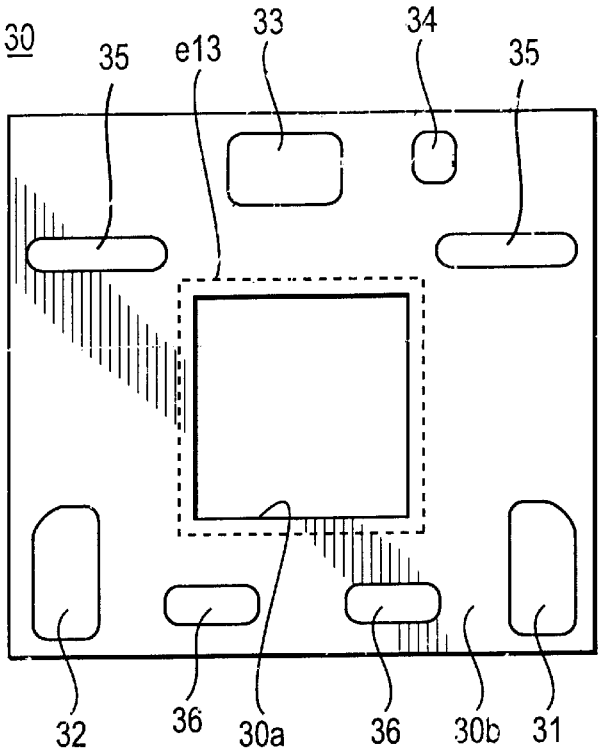
FIG. 8 is a plan view of the resin member used in another modification of the irreversible circuit component of FIG. 1, viewed from the under side thereof.
Figure 9:
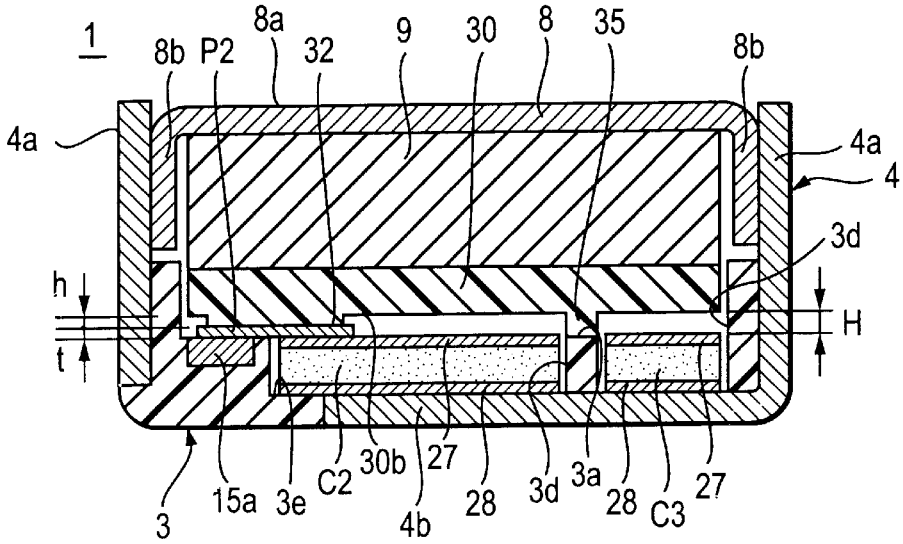
FIG. 9 is a vertical cross-sectional view of still another modification of the irreversible circuit component of FIG. 1.

Furthermore, convexities 35 and 36 may be formed on the under face 30*b* of the resin member 30 instead of the convexities 41 to 43 formed on the resin case 3, as shown in FIGS. 8 and 9. The height H of the convexities 35 and 36 is set to be equal to the sum of the height h of the concavity 32 formed on the under face 30*b* of the resin member 30 and the thickness of the ports P1 to P3. The convexities 35 and 36 of the resin member 30 contact the bottom 3*a* of the resin case 3. The resin member 30 is supported via the convexities 31 to 36. Thus, the same operation and effects as those of the isolator 1 shown in FIGS. 1 to 6 can be obtained.

Moreover, a convexity may be formed on the bottom 3*a* of the resin case 3, and a convexity may be formed on the under face 30*b* of the resin member 30, though not shown. Then, the convexity formed on the bottom 3*a* of the resin case 3 contacts the convexity formed on the under face 30*b* of the resin member 30. The sum of the height of the convexity formed on the bottom 3*a* and the height of the convexity formed on the under face 30*b* is set to be equal to the sum of the height h of the convexities 31 and 32 formed on the under face 30*b* of the resin member 30 and the thickness t of the ports P1 to P3. The resin member 30 is supported via the convexities. Thus, the same operation and effects as those of the isolator 1 shown in FIGS. 1 to 6 can be obtained.

Second Embodiment

Figure 10:
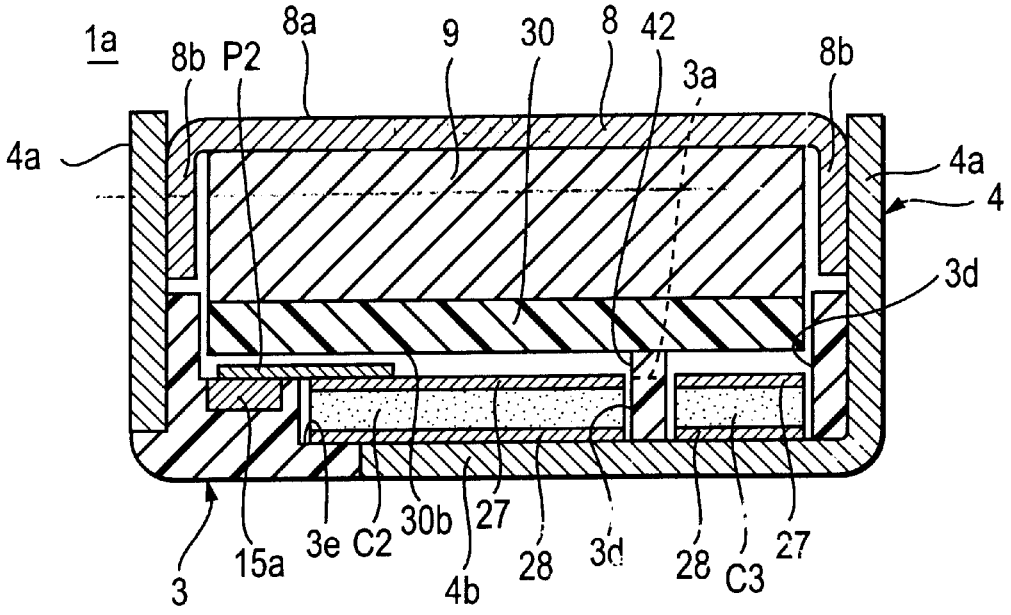
FIG. 10 is a vertical cross-sectional view of an irreversible circuit component according to a second embodiment of the present invention.

FIG. 10 shows a irreversible circuit component according to a second embodiment of the present invention. The resin case 3 of the lumped-constant isolator 1*a* of the second embodiment has substantially the same structure as the resin case 3 of the above-described lumped-constant isolator 1 of the first embodiment. In particular, convexities 41 and 42 which are the same as those shown in FIG. 3 are formed on the bottom 3*a* of the resin case 3. The convexities 41 and 42 contact the resin member 30.

In the second embodiment, the under face 30*b* of the resin member 30 is flat with no convexity being formed thereon. Moreover, the center electrodes 21 to 23 are bent so as to contact the terminal electrodes 27 on the hot sides of the matching capacitor elements C1 to C3 and the terminal electrode 19 on the hot side of the resistance element R, respectively. As regards the structure of the isolator 1*a,* the terminal electrodes 27 on the hot sides press the ports P1 to P3 by utilization of the spring properties of the center electrodes 21 to 23, respectively. As material for the center electrodes 21 to 23, copper, silver or the like having elastic properties and a low loss is employed.

For connection of the ports P1 to P3, the terminal electrode 19 on the hot side of the resistance element R, the terminal electrodes 27 on the hot sides of the matching capacitor elements C1 to C3, and the input-output lead-out electrodes 14*a* and 15*a,* Sn—Sb type, Sn—Pb type, and Sn—Ag type solders are used. In particular, it is preferred that the Sn—Sb type solder, which is a non-lead type solder having a high melting point, is used, from the standpoint of the prevention of environmental contamination and the melting workability of the irreversible circuit component 1*a*. The connection between the electrodes is not limited to soldering. For example, an electrically conductive agent may be used. Moreover, welding and wire-bonding may be employed.

According to the second embodiment, the same operation and effects as those of the first embodiment can be obtained. Moreover, the pressure used for the assembly, that is, for mounting of the permanent magnet 9 and covering with the upper case 8 is transmitted to the resin case 3 via the resin member 30, not transmitted to the resistance element R and the matching capacitor elements C1 to C3. As a result, breaking of the resistance element R, the matching capacitor elements C1 to C3, and the ferrite 20 of the center electrode assemblage 13 can be prevented.

Also, the impact resistance can be enhanced. Especially, when the under faces of the resistance element R and the matching capacitor elements C1 to C3 contact both of the bottom wall 4*b* of the lower case 4 and the element-contact portions 3*e* of the resin case 3, that is, when the materials having different elasticities are arranged beneath the resistance element R and the matching capacitor elements C1 to C3, breaking of these elements, which may be caused by the difference in elastic displacement between the bottom wall 4*b* of the lower case 4 and the element-contact portions 3*e* of the resin case 3, can be prevented. Moreover, since the ports P1 to P3 of the center electrodes 21 to 23 are bent so as to contact the terminal electrodes 27 on the hot sides of the matching capacitor elements 11 to 13 and the terminal electrode 19 on the hot side of the resistance element R, respectively, an unsuitable opening defect can be prevented.

In this embodiment of the invention it is not necessary to provide a convexity on the under face 30*b* of the resin member 30. Thus, the structure of a metal mold for forming the resin member 30 can be simplified, and the cost of the mold can be reduced. Molding of the resin member 30 can be facilitated. On the other hand, since the inner surface of the resin case 3 has a complicated shape in itself, the cost of the mold hardly increases when the convexities 41 and 42 are formed on the resin case 3. Thus, the total cost of the metal molds for the resin member 30 and the resin case 3 can be reduced. Accordingly, the isolator 1*a* which can be easily assembled and handled and which has high reliability and low cost can be provided.

Figure 11:
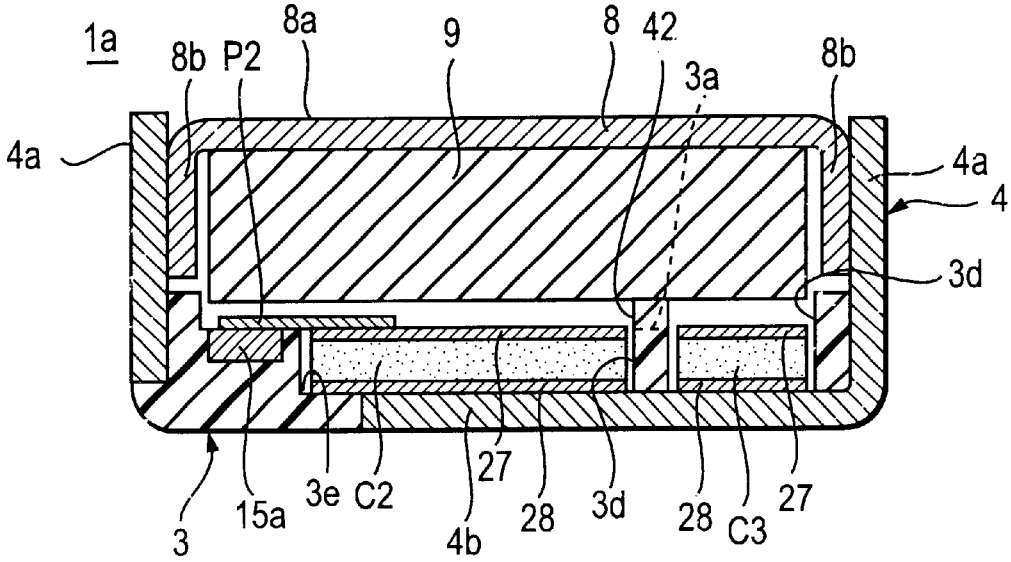
FIG. 11 is a vertical cross-sectional view of a modification of the irreversible circuit component of FIG. 10.

The second embodiment is not limited to the above-description. For example, as shown in FIG. 11, there may be no resin member 30 mounted in the isolator 1*a*. In this case, only the convexities 41 and 42 of the resin case 3 contact the under face of the permanent magnet 9 to support the permanent magnet 9. Thus, the pressure applied for the assembly, that is, for mounting of the permanent magnet 9 and covering with the upper case 8 is transmitted directly to the resin case 3, not transmitted to the resistance element R, the matching capacitor elements C1 to C3, and the ferrite 20 of the center electrode assemblage 13. As a result, the same operation and effects as described above can be obtained. Moreover, the resin member is unnecessary. Thus, the metal mold for the resin member is not needed. The manufacturing cost of the resin member can be saved. Thus, the manufacturing cost of the isolator 1*a* can be reduced. Furthermore, the thickness of the resin member 30 in the thickness direction of the isolator 1*a* can be omitted. Thus, the thickness of the isolator 1*a* shown in FIG. 11 can be reduced, corresponding to the thickness of the resin member 30. The height of the isolator 1*a* can be reduced. As a result, the isolator 1*a* of which the reliability is high and the cost is low can be provided.

Figure 12:
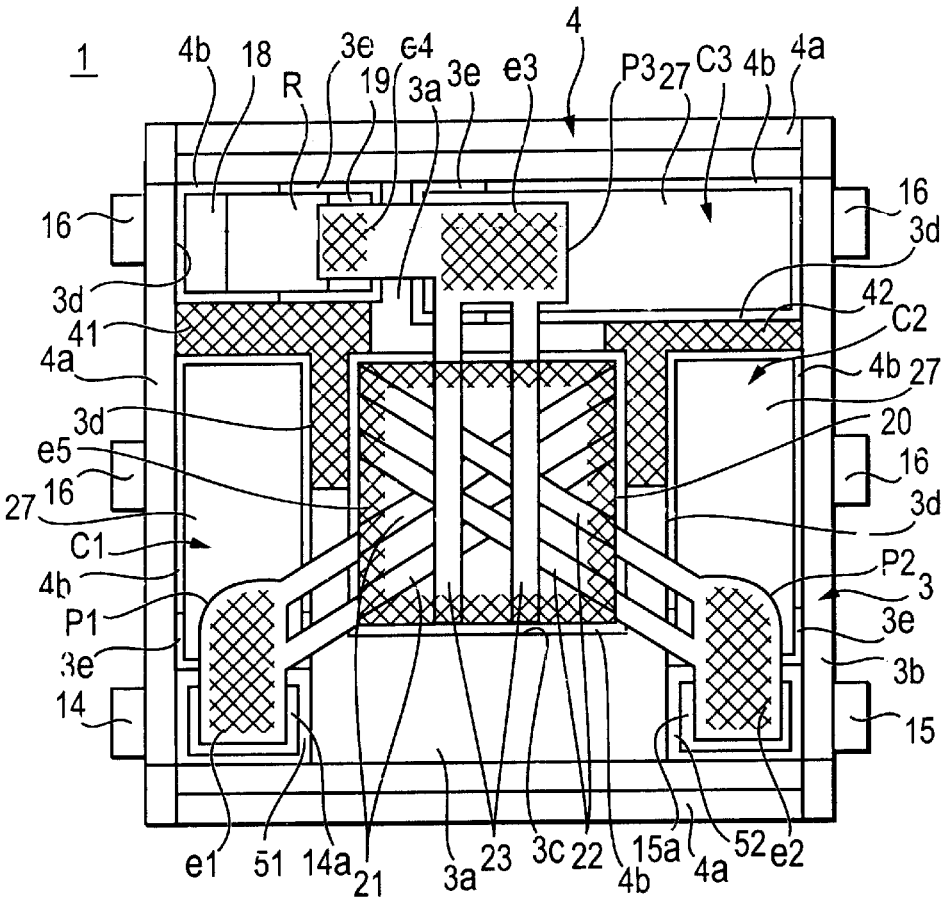
FIG. 12 is a plan view showing the inside of still another modification of the irreversible circuit component of FIG. 10.
Figure 13:
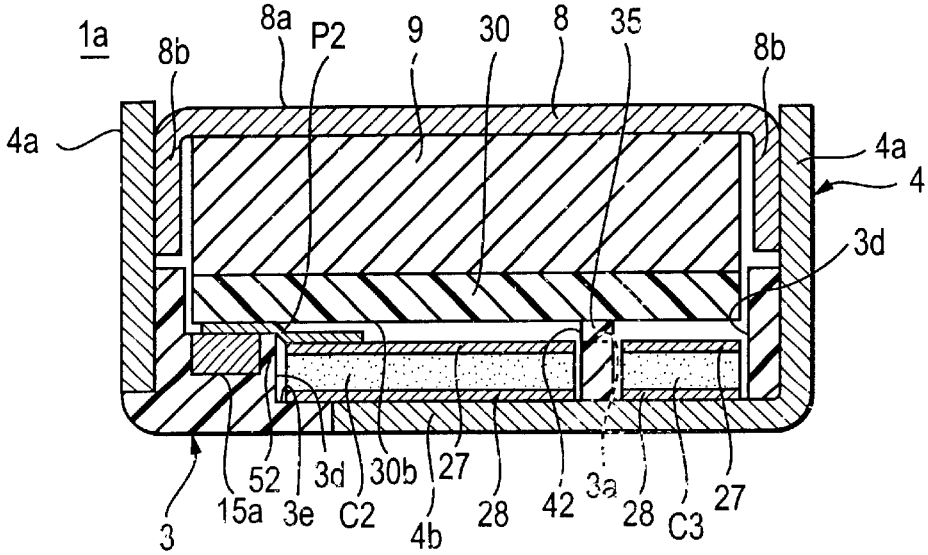
FIG. 13 is a vertical cross-sectional view of the irreversible circuit component of FIG. 12.

Furthermore, as shown in FIGS. 12 and 13, convexities 51 and 52 may be formed on the resin case 3. The input lead-out electrode 14*a* is formed on the convexity 51, and the output lead-out electrode 15*a* is formed on the convexity 52. As shown in FIG. 13, the port P2 of the center electrode 22 arranged on the terminal electrode 27 on the hot side of the matching capacitor element C2 is bent and extended so as to conform to the shape of the convexity 52, and is electrically connected to the output lead-out electrode 15*a*. Similarly, the port P1 of the center electrode 21 arranged on the terminal electrode 27 on the hot side of the matching capacitor element C1 is bent and extended so as to conform to the shape of the convexity 51, and is electrically connected to the output lead-out electrode 14*a,* though not shown.

Preferably, the height of the convexity 51 is equal to the value obtained by subtracting the thickness of the port P1 from the height of the convexity 41, and the height of the convexity 52 is equal to the value obtained by subtracting the thickness of the port P2 from the height of the convexity 42.

As regards the convexities formed on the resin case 3, if the convexities 51 and 52 provided with the input-output lead-out terminals 14*a* and 15*a* are used, the resin member 30 can be stably supported by two convexities, that is, the convexities 41 and 42. As a result, the pressure applied for the assembly, that is, for mounting of the permanent magnet 9 and covering with the upper case 8 is divided and transmitted to the resin case 3.

The present invention can be applied to the isolator 1*a* in which the convexities 51 and 52 of the resin case 3 are formed so that the respective top faces thereof are at a higher position than the corresponding top faces of the ports P1 and P2 of the center electrodes 21 and 22, whereby the resin member 30 is omitted, though not shown. The isolator 1*a* can be reduced by the thickness of the resin member 30. As a result, the isolator 1*a* can be provided which has such a structure as facilitates the assembly and handling and of which the reliability is high and the cost is low.

Figure 14:
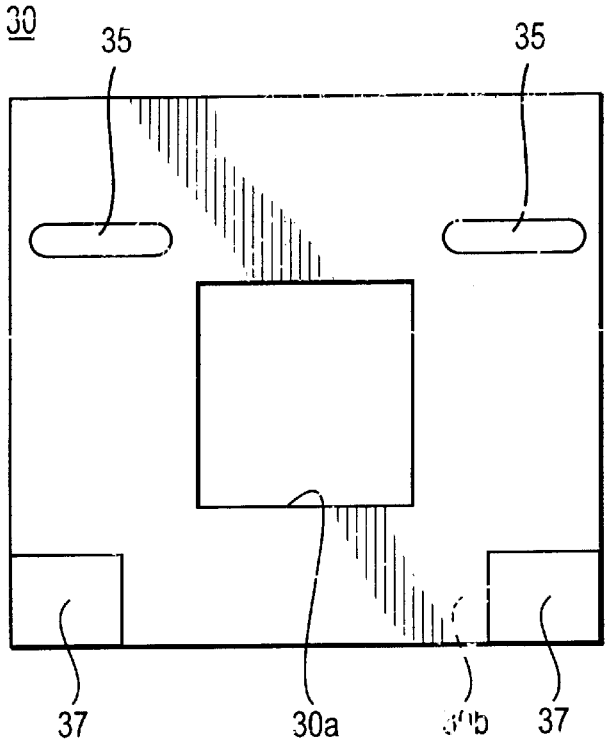
FIG. 14 is a plan view of a resin member used in yet another modification of the irreversible circuit component of FIG. 10, viewed from the under face side thereof.
Figure 15:
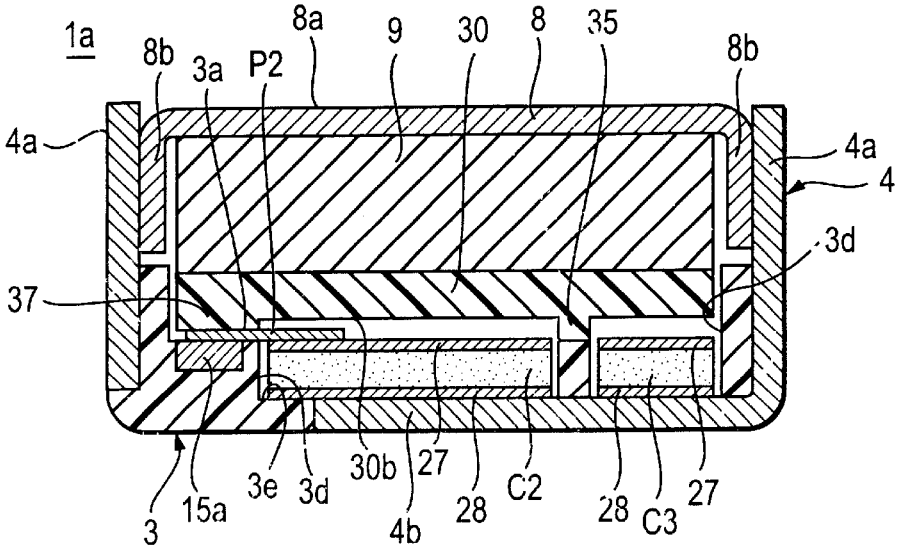
FIG. 15 is a vertical cross-sectional view of another modification of the irreversible circuit component of FIG. 10.

Moreover, as shown in FIGS. 14 and 15, two convexities 37, instead of the convexities 31 and 32, may be provided on the under face 30*b* of the resin member 30. The convexities 37 are formed in the corners of the resin member 30, and press the ports P1 and P2 of the center electrodes 21 and 22 to contact the input lead-out electrode 14*a* and the output lead-out electrode 15*a,* with the ports P1 and P2 being interposed, respectively. The hole 30*a* is set at such a size that it can accommodate the center electrode assemblage 13. In this case, the convexities 35 are placed on the bottom 3*a* of the resin case 3, and the convexities 37 of the resin member 30 are placed on the bottom 3*a* where the input-output lead-out electrodes 14*a* and 15*a* are provided, with the ports P1 and P2 being interposed.

Accordingly, the pressure applied for the assembly, that is, for mounting of the permanent magnet 9 and covering with the upper case 8 is transmitted to the resin case 3, not transmitted to the resistance element R, the matching capacitor elements C1 to C3, and the ferrite 20 of the center electrode assemblage 13 which do not contact the resin member 30. As a result, the breakage of the resistance element R and the matching capacitor elements C1 to C3 can be prevented more effectively. That is, the impact resistance can be enhanced. The isolator 1*a* which can easily be assembled and handled and which has high reliability and low cost can be provided.

Third Embodiment

As a communication device according to a third embodiment of the present invention, a portable telephone will be described as an example.

Figure 16:
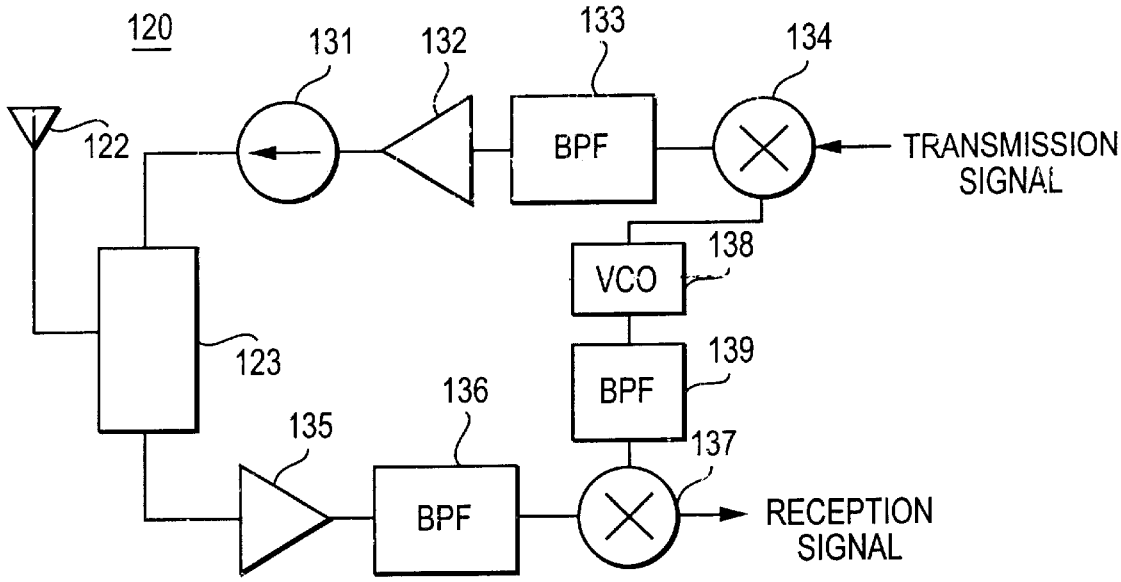
FIG. 16 is a block diagram showing a communication device according to a third embodiment of the present invention.
Figure 17:
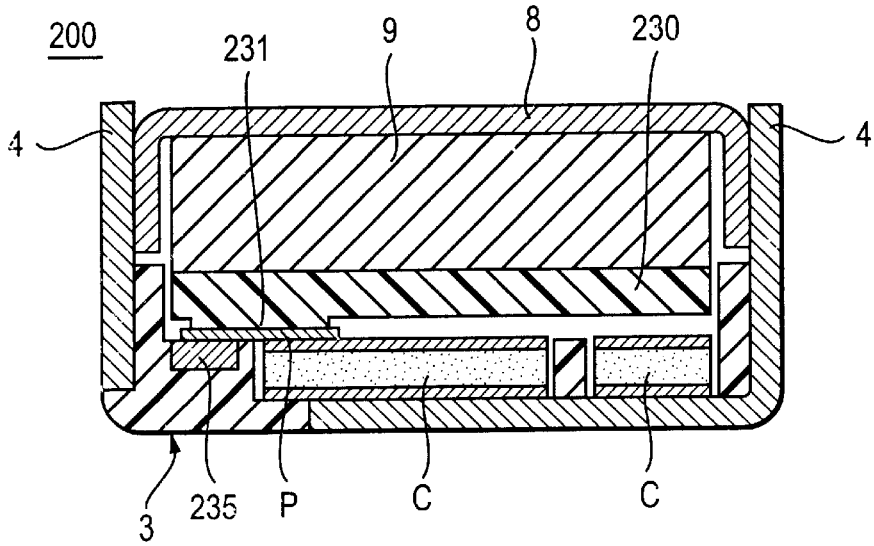
FIG. 17 PRIOR ART
FIG. 17 is a vertical cross-sectional view of a conventional irreversible circuit component.

FIG. 16 is an electric circuit block diagram of the RF part of a portable telephone 120. In FIG. 16, an antenna element 122, a duplexer 123, a transmission-side isolator 131, a transmission-side amplifier 132, a transmission-side inter-stage band pass filter 133, a transmission-side mixer 134, a reception-side amplifier 135, a reception-side inter-stage band pass filter 136, a reception-side mixer 137, a voltage control oscillator 138 (VCO), and a local band pass filter 139 are shown.

As the transmission-side isolator 131, the lumped-constant isolator 1 or 1*a* according to the first or second embodiment may be used. A portable telephone of which the cost is low and the reliability is high can be realized by utilizing the lumped-constant isolator 1 or 1*a*.

Other Embodiments

The present invention is not limited to the above-described embodiments. Various changes in the structure may be resorted to without departing from the spirit of the invention. For example, the above-described embodiments deal with isolators. It is needless to say that the present invention may be applied to a circulator and moreover to other high frequency parts.

Furthermore, the center electrodes are formed by punching a metal sheet, and bending. In addition, the center electrodes may be integrally formed by etching. Moreover, the intersecting angles of the center electrodes may be in the range of 110 to 140°.

The metal case may be divided into at least three parts.

The ferrite is not limited to the rectangular parallelepiped shape, and may have another shape such as a disk or hexagonal shape.

Moreover, the shapes of the convexities may be, e.g., tapered, step, hemisphere, and arc shapes in cross-section, in addition to the rectangular shapes. Needless to say, the convexities are not limited to the above-described shapes. The heights of the convexities are such that the resin member and the permanent magnet can be supported so as to be substantially in parallel. Furthermore, a hole of which the diameter is substantially equal to the outer diameter of the permanent magnet may be formed in the center of the resin member, and the permanent magnet may be fitted into the hole. Needless to say, the resistance element and the matching capacitor elements may be different in thickness.

As seen in the above-description, according to the present invention, the resin case contacts at least two contact-portions which are provided on the main face side of the resin member, the permanent magnet or the like. Thus, the resin member can contact not only the internal components but also the bottom of the resin case. Accordingly, the pressure applied for mounting of the permanent magnet and covering of the metal case is divided and transmitted to the resin case and the internal components. This is effective in preventing breaking of the internal components. An irreversible circuit component which is easy to assemble and handle and which has high reliability and low cost can be provided.

The communication device in accordance with the present invention includes the irreversible circuit component having the above-described characteristics. Thus, the cost of the communication device is low, and its reliability is high.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An irreversible circuit component comprising:

a permanent magnet;

a ferrite to which the permanent magnet applies a DC magnetic field;

a plurality of center electrodes arranged on the ferrite;

an internal component;

a resin member arranged above the internal component;

a metal case accommodating the permanent magnet, the ferrite, and the center electrodes; and a resin case accommodating the ferrite, the center electrodes, the internal component, and the resin member; wherein the resin member includes at least two contact-portions on a main face thereof such that the two contact-portions contact the resin case; and the resin case is provided with convexities which contact the at least two contact-portions.

2. An irreversible circuit component according to claim 1, wherein the contact-portions each comprise convexities formed on the main face on the internal component side of the resin member.

3. An irreversible circuit component according to claim 1, wherein the resin member comprises a material selected from the group consisting of a liquid crystal polymer and PPS.

4. An irreversible circuit component comprising:

a permanent magnet;

a ferrite to which the permanent magnet applies a DC magnetic field;

plural center electrodes arranged on the ferrite;

an internal component;

a metal case including a lower portion and an upper portion, the lower portion accommodating the permanent magnet, the ferrite, and the center electrodes;

a resin case integrated with the lower portion of the metal case so as to define a single structure and accommodating the ferrite, the center electrodes, and the internal component; and at least two contact-portions being defined on a main face on the internal component side of the permanent magnet; wherein the resin case contacts the at least two contact-portions and supports the permanent magnet.

5. An irreversible circuit component according to claim 4, wherein the resin case is provided with convexities which contact the contact-portions.

6. An irreversible circuit component according to claim 1 or claim 4, wherein a terminal of a respective one of said center electrodes is electrically connected to a terminal electrode of the internal component and also to an input-output electrode provided on the resin case.

7. An irreversible circuit component according to claim 1 or claim 4, wherein the bottom of the internal component contacts an inner wall of the resin case and also a surface of the metal case exposed to the inner wall of the resin case.

8. An irreversible circuit component according to claim 1 or claim 4, comprising three contact-portions.

9. An irreversible circuit component according to claim 1 or claim 4, wherein the resin case comprises a material selected from the group consisting of a liquid crystal polymer and PPS.

10. A communication device comprising a high-frequency circuit, said circuit including at least one irreversible circuit component as defined in claim 1 or claim 4.

* * * * *